US005425673A

United States Patent [19]

Mahlanen et al.

[11] Patent Number: 5,425,673

[45] Date of Patent: Jun. 20, 1995

[54] FIRE CLOSURE SHUTTER

[75] Inventors: Timo Mahlanen; Kimmo Ritvanen, both of Helsinki; Arvo Räsänen, Vantaa; Outi Siivonen, Helsinki, all of Finland

[73] Assignee: Kvaerner Masa-Yards OY, Helsinki, Finland

[21] Appl. No.: 105,307

[22] Filed: Aug. 11, 1993

[30] Foreign Application Priority Data

Aug. 12, 1992 [FI] Finland ..... 923601

[51] Int. Cl.[6] ..... F24F 13/15

[52] U.S. Cl. ..... 454/369; 137/601; 251/356; 454/335

[58] Field of Search ..... 137/601; 251/314, 356; 454/257, 258, 278, 335, 369

[56] References Cited

U.S. PATENT DOCUMENTS

| | | | |
|---|---|---|---|
| 2,805,453 | 9/1957 | Petronello et al. . | |
| 3,360,018 | 7/1966 | Schuh | 454/369 X |
| 3,447,443 | 6/1969 | Silvey | 454/335 |
| 3,530,783 | 9/1970 | Alamprese . | |
| 3,643,582 | 2/1972 | Mochida | 454/335 |
| 3,793,932 | 2/1974 | Tarnoff | 454/335 |
| 4,766,807 | 8/1988 | Davis | 137/601 X |

FOREIGN PATENT DOCUMENTS

| | | |
|---|---|---|
| 0045172 | 2/1982 | European Pat. Off. . |
| 0068969 | 1/1983 | European Pat. Off. . |
| 3343038 | 5/1984 | Germany . |
| 1200980 | 8/1970 | United Kingdom . |
| 1393873 | 5/1975 | United Kingdom . |
| 2098475 | 11/1982 | United Kingdom . |
| 2112282 | 7/1983 | United Kingdom . |
| 2130882 | 6/1984 | United Kingdom . |
| 2150829 | 7/1985 | United Kingdom . |
| 2244214 | 11/1991 | United Kingdom . |

*Primary Examiner*—Harold Joyce
*Attorney, Agent, or Firm*—Smith-Hill and Bedell

[57] ABSTRACT

A fire shutter comprises a plurality of substantially planar fire plate elements each having first and second opposite edges and supported so that they are adjacent to each other and turnable about respective parallel axes from a flow-through open position, in which gas-flow passages are formed between the plate elements, to a closed position, in which the first edge of one plate element of each pair of adjacent plate elements is close to the second edge of the other plate element of the pair and the fire plate elements together form a closed barrier. The first edge of the one plate element is provided with a sealing structure including a plane part, which laps over an area adjacent the second edge of the other plate element to lie substantially parallel to the plane of that area of the other plate element, and a transverse part which is substantially perpendicular to the plane part and confronts the second edge of the other plate element, whereby distortion of the other plate element does not create a significant gap between the one plate element and the other plate element.

19 Claims, 3 Drawing Sheets

FIRE CLOSURE SHUTTER

BACKGROUND OF THE INVENTION

The invention relates to a fire closure shutter.

Especially in the ventilation ducts in ships there is a need for fire closure shutters the purpose of which is to separate, in the event of fire, the area under fire from the other spaces of the ship. The cross-sectional area of this kind of air duct can be about two square meters and the fire closure shutter must form a barrier able to close the whole of this area. For the acceptance of a fire closure shutter a fire test is arranged in which at one side of the closed shutter a temperature corresponding to that of a fire prevails for one hour. Severe thermal stress caused during the fire test generally causes distortion of the elements of the shutter creating non-acceptable gaps in the barrier created by the elements of the shutter.

SUMMARY OF THE INVENTION

An aim of the invention is to create a fire closure shutter which resists heat well and which is constructed so that even a very severe thermal stress fails to cause any significant gaps to appear in the closed fire closure barrier created by the shutter.

A fire closure shutter according to the invention comprises a number of plate elements arranged adjacent to each other and mounted to turn about mutually parallel axes. Shape changes caused by thermal stress usually occur on the edge areas of a plate element where in its closed position it is in contact with the adjacent plate element. In addition shape changes caused by thermal stress usually occur in directions substantially perpendicular to the plane of the plate element. In a construction according to the invention one edge of a plate element is provided with a transverse part extending perpendicular to the plane of the plate element, and because the usual distortion of the edge area of the adjacent plate element caused by thermal stress occurs in the direction of the plane of the transverse part, the clearance between the adjacent plate element and the transverse part does not increase significantly. Thus, the invention is based on the principle that, due to the construction, shape changes caused by thermal stress do not, to any significant extent, cause gaps to appear in the fire closure shutter.

The solution provided by the invention can be accomplished in a simple way by fixing (e.g. welding) on one edge of a plate member an L-shaped steel or the like heat-resistant profiled element, one part of which serves as the transverse part and the other part of which is substantially parallel to the plane of the plate element. The use of an L-shaped steel edge reinforcement provides an advantageous solution particularly with regard to costs. Alternatively by bending the edge part of a plate element it is possible to form an integral construction which has both a transverse part and a part parallel with the plate element avoiding the need to weld a separate edge part to the plate element. However, the kind of edge area bending needed require the use of a relative expensive plate bending apparatus because the thickness of the material of the plate element would typically be about 5 mm.

The presence of a transverse part could cause a minor disadvantage in the open position of the shutter, because it could reduce the free flow-through area of the shutter opening. However, if the dimension of the transverse part of each plate element can be reduced so that in the direction perpendicular to the plane of each plate element it does not substantially exceed the corresponding dimension of the construction located at the position of the turning shaft for the plate element, the transverse part of the plane element will not per se affect the size of the flow-through area of the shutter opening.

In a favored embodiment the turning axis for the different plate elements is located in the central region of each plate element. In this way a balanced plate element is more easily achieved, to which the air flow through the shutter opening does not create a turning force on the plate elements, for example, so that a strong air flow resists a closing of the shutter.

In order to keep the distortions of the plate elements caused by thermal stress sufficiently small, the size of the plate elements has to be limited. It has been proved in practice that very wide plate elements should be avoided and that plate elements manufactured to have a pitch between the turning axes thereof which is at the most 30 cm, and preferably is about 20 cm, are advantageous.

It is important for good fire resistance of the fire closure shutter that harmful distortions be avoided also in the vicinity of the frame of the shutter. Therefore the frame supporting the turnable plate elements must be rigid and it must not be disposed to thermal distortion. A desirable degree of rigidity is obtained if the width of the frame in the through-flow direction of the open shutter is greater than the pitch between the turning axes of the plate elements. The frame can with advantage be manufactured of U-shaped channel-section members arranged so that the outer bottom surface of each U-shaped member faces the gas flow opening.

For turnably journalling of the plate elements in the frame only stub shafts or the like are needed at opposite ends of the plate elements, but the longitudinal part of each plate element located between the stub shafts is suitably provided with a bent area or the like aligned with the longitudinal axes of the stub shafts to make the plate element more rigid.

In most cases a thickness of the plate elements and the walls of the frame of about 5 mm has been found to be sufficient.

All the components of the fire closure structure must be made of fire resistant material. Preferably, the structural components, including the fire plate elements, the shafts, and the frame are made of steel of other suitable metal.

For security reasons it is desirable to provide the shutter with an operating system, which turns the plate elements thereof into their closed position by a force generated independently of an external energy source (e.g. a spring force) preferably arranged so that in the closed position of the plate elements some residual force exists for urging the plate elements into the closed position. The result of this arrangement provides the advantage that the fire shutter automatically adopts its closed position and remains tightly closed in the event of a failure of any external energy source provided in the environment (e.g. a loss of electrical, hydraulic or pneumatic power).

BRIEF DESCRIPTION OF THE DRAWINGS

The invention will now be described in more detail, by way of example, with reference to the accompanying drawings, in which.

DETAILED DESCRIPTION

Figure 1:
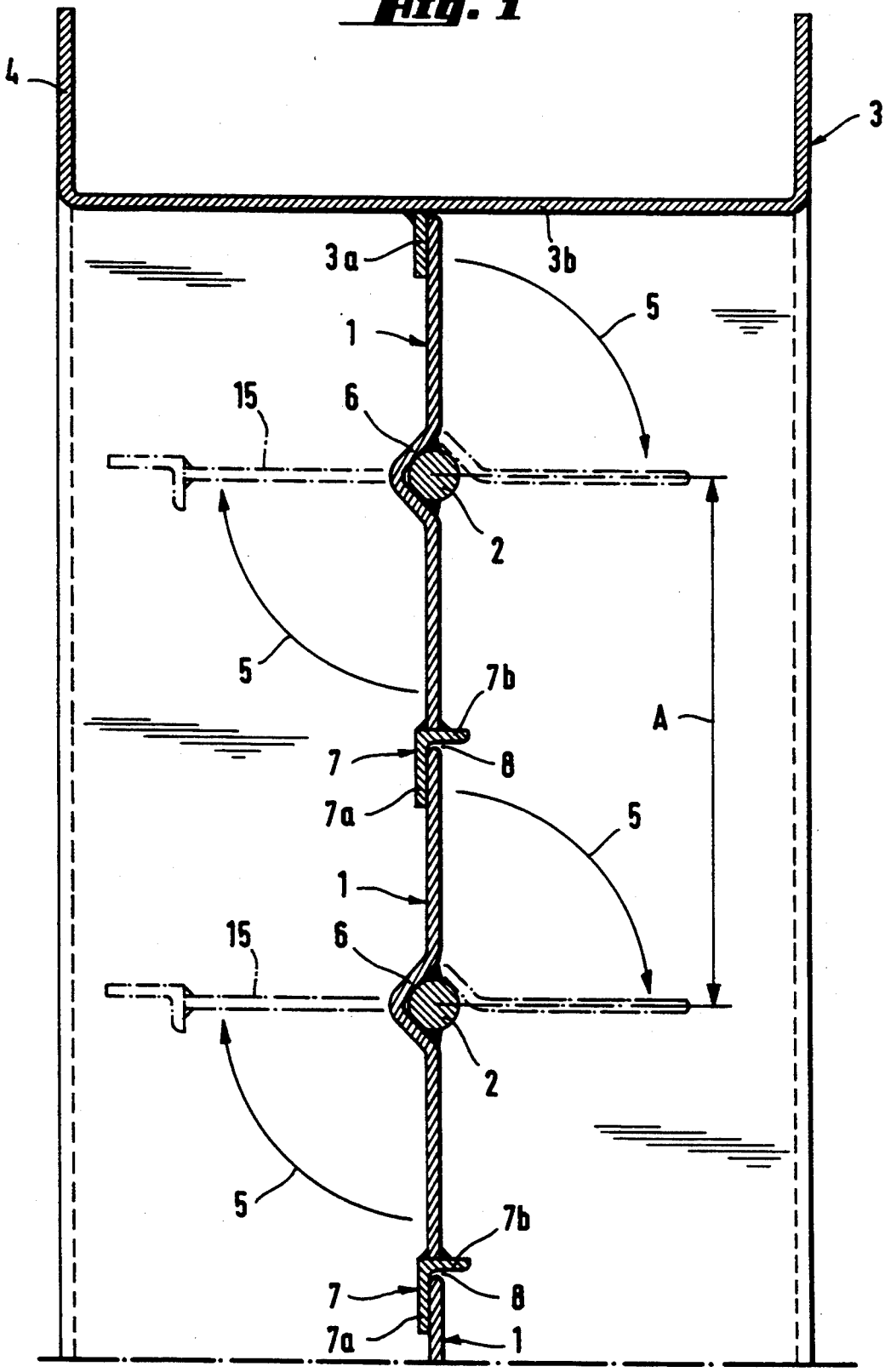
FIG. 1 is a cross-sectional view of the upper part of a fire closure shutter according to the invention.

In the drawings, 1 indicates fire plate elements and 2 stub shafts thereof. The plate elements 1 are turnably journalled by means of the stub shafts 2 in a rectangular frame 3, which is made of U-shaped channel members 4. The plate elements 1 and the channel members 4 are made of steel plate material, preferably about 5 mm thick.

Figure 2:
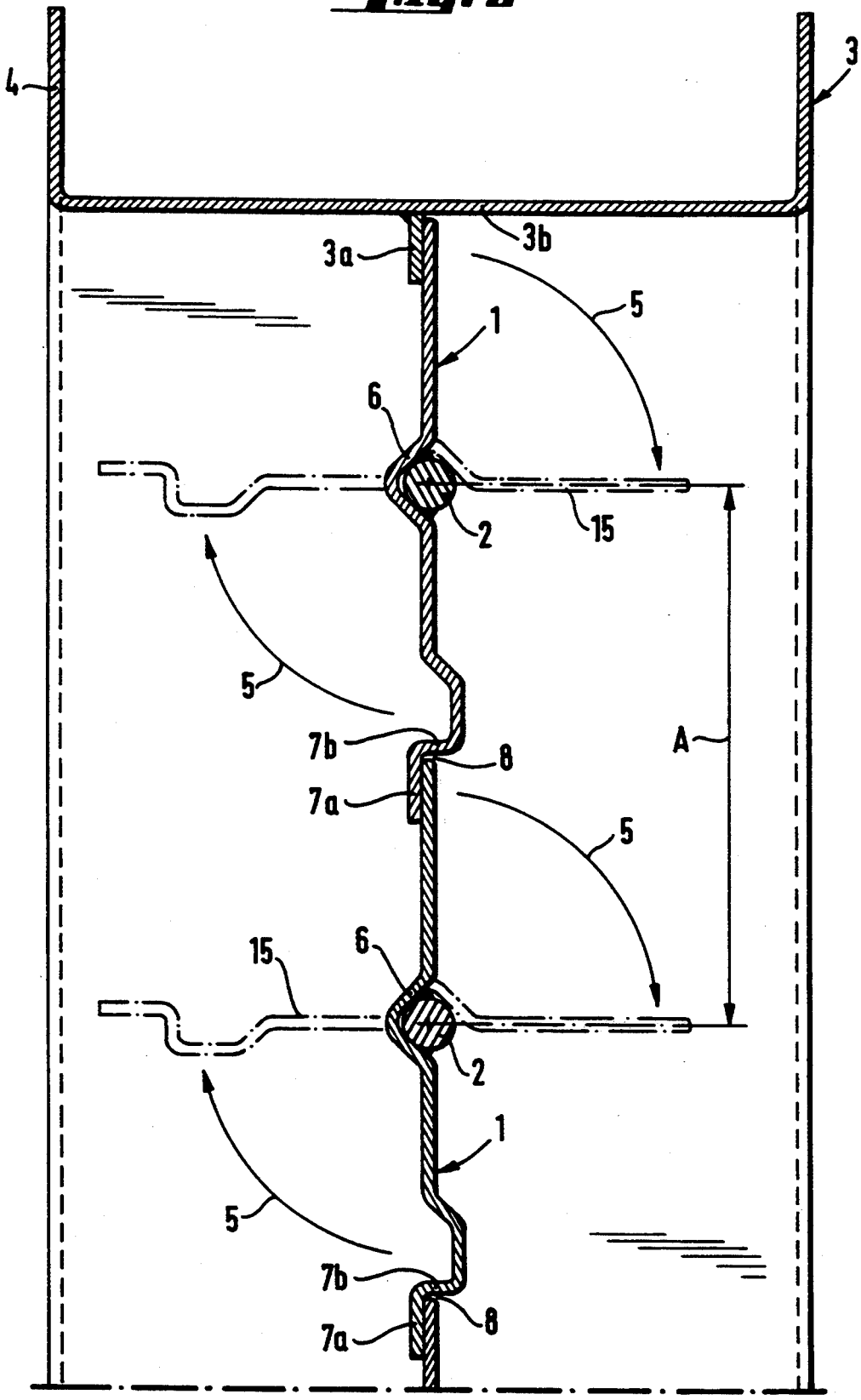
FIG. 2 shows an alternative construction of the fire closure shutter according to FIG. 1.

The turning movements of the plate elements 1 from a closed position shown by full lines in FIGS. 1 and 2 to an open position shown by chain lines 15, is shown by arrows 5. The stub shafts 2 of the plate elements are welded to the ends of the plate elements in a channel 6 bent from a central part of each plate element. Fixed along one edge of each plate element is an L-shaped steel member 7 including a plane part *7a* and a transverse part *7b*. A rim part *3a* projects into the gas flow opening of the frame 3 and corresponds to the plane part *7a* of the L-shaped member 7 and a transverse part *3b* of the frame corresponds to the transverse part *7b* of the L-shaped member 7 to ensure good sealing of the outermost plate element 1 to the frame 3. In the lowermost plate element (not shown in FIG. 1) there is no need for a member 7 or the like construction but a rim part similar to *3a* can be provided to form a stop element indicating the closed position of the lowermost plate element 1.

When the temperature on one side of the fire shutter is extremely high compared to that on the other side, the plate elements 1 may bend due to the temperature gradient, whereby especially at the end of each plate element, having no reinforcing element 7, noticeable shape changes may occur. These shape changes take place, however, substantially in the direction of the plane of the transverse part *7b* of the L-shaped member 7, which has no essential effect on the size of the clearance 8 of about 2 mm left between the outer edge of the plate element 1 and the adjacent transverse part *7b*. Thus distortion of the edge of the plate element 1 away from the plane part *7a*, even though it will result in an increase of the size of the space between the plate element and the plane part *7a* of the L-shaped steel member, does not give rise to the creation of a gap because the size of the clearance 8 remains practically the same provided the edge area of the plate element 1 is not distorted so excessively that it moves beyond the outer edge of the transverse part *7b*. It is not difficult to ensure this does not occur even where the transverse part *7b* is relatively short.

There is no need to make the transverse part *7b* in the sealing structure between the plate elements very long, indeed it is undesirable to do this because it could have a harmful effect, in the sense that it could decrease the flow-through opening in the open position 15 of the plate elements. Assuming that the total length of the transverse part *7b* does not exceed the extent to which the bent area 6 is bent away from the median plane of the plate element, the transverse part *7b* will have no reducing effect on the maximum size of the flow-through opening.

The embodiments illustrated show the turning axis of each plate element 1 located in the central area of the respective plate elements. This is preferred since in this way each plate element is balanced.

The length of the frame of the fire closure shutter in the flow-through direction of the opening is substantially greater than the pitch A between the turning axes of the plate elements, which in the embodiments illustrated is about 20 cm. This arrangement makes the frame particularly rigid and provides the advantage that no part of the turnable plate elements can ever extend outside of the frame, where they could be damaged, whereby transportation of the fire shutter is facilitated. Desirably the frame is of simple construction and as shown is made of four U-shaped channel-section members, the opening to be closed by the plate elements being defined by the bottoms of the four U-shaped members. The thickness of the walls of the frame and the plate elements is 5 mm.

FIG. 2 shows an alternative sealing structure between the plate elements, in which the transverse part is provided by bending the plate element 1 as shown in the figure.

Figure 3:
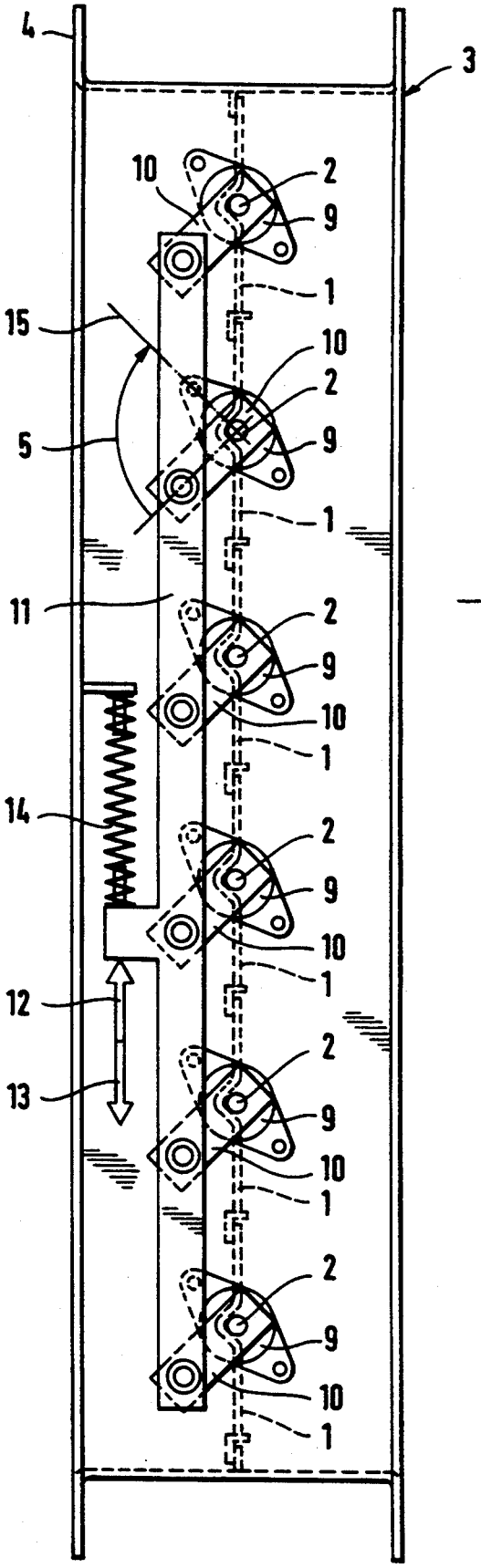
FIG. 3 is a side view of the fire closure shutter according to FIG. 1.

FIG. 3 shows a suitable operating system for the plate elements. The stub shafts of the plate elements are turnably journalled in bearing housings 9 and a turning lever 10 is fixed to the stub shaft 2 of each plate element at one side of the flow opening (suitably, as shown, in one of the U-shaped channel-section members). The turning levers 10 are turnably fixed to a common operating bar 11, to which an open-holding force, acting parallel to the arrow 12, is applied for example by means of an electrical solenoid device or the like. In the opposite direction (i.e. in the direction of the arrow 13) there acts, for instance, the force of a compression spring 14 or the like, which automatically closes the fire shutter when the open-holding force is removed (e.g. if there is such a disturbance in an external energy system that the open-holding force provided by the solenoid or the like disappears). The spring 14 is designed so that even in the described closed position of the shutter the plate elements are urged further towards the closed position.

The invention is not restricted to the embodiment illustrated, since several modifications are feasible within the scope of the following claims.

We claim:

1. A fire closure shutter comprising at least first and second fire plate elements each having first and second opposite sides, means supporting the fire plate elements adjacent to each other and turnable about respective parallel axes from a flow-through open position, in which gas-flow passages are formed therebetween, to a closed position, in which one edge of the first fire plate element is adjacent one edge of the second fire plate element and the fire plate elements together form a closed barrier, wherein said one edge of the first fire plate element is provided with a sealing structure including a leaf part, which contacts the first side of the second plate element and laps over the second plate element adjacent said one edge thereof when the fire plate elements are in the closed position, and a transverse part which is substantially perpendicular to the leaf part and, when the fire plate elements are in the closed position, confronts said one edge of the second plate element and extends from the leaf part to beyond the second side of the second plate element, whereby distortion of the second plate element does not create a significant gap between the first and second plate elements.

2. A fire shutter according to claim 1, wherein the sealing structure comprises an L-shaped profiled member of fire resistant material fixed to said one edge of the first plate element.

3. A fire shutter according to claim 2, wherein the profile member is steel and is welded to the first plate element.

4. A fire shutter according to claim 1, wherein the sealing structure is a bent region adjacent to said one edge of the first plate element.

5. A fire shutter according to claim 1, wherein the first plate element is substantially planar and comprises a shaft construction at the location of its turning axis and the dimension of the transverse part measured perpendicular to the plane of the first plate element does not substantially exceed the corresponding dimension of the shaft construction.

6. A fire shutter according to claim 1, wherein the turning axis for each plate element is located substantially in the central region thereof.

7. A fire shutter according to claim 1, wherein the pitch between the turning axes of the first and second plate elements is at the most 30 cm.

8. A fire shutter according to claim 7, wherein the pitch is about 20 cm.

9. A fire shutter according to claim 1, comprising a frame of rigid construction defining a gas flow opening, and wherein the extent of the frame in the flow-through direction of the shutter is greater than the pitch between the turning axes of the plate elements.

10. A fire shutter according to claim 9, wherein the frame is composed of U-shaped channel-section members arranged so that the outer bottom surface of each U-shaped member faces the gas flow opening defined by the frame.

11. A fire shutter according to claim 10, wherein the thickness of the walls of the frame is about 5 mm.

12. A fire shutter according to claim 1, wherein the first and second plate elements are provided with shaft means for supporting the plate elements.

13. A fire shutter according to claim 12, wherein each plate element has two opposite ends and the shaft means comprises two stub shafts at opposite respective ends of the first plate element and spaced apart along the first plate element, and the longitudinal part of the first plate element located between the two stub shafts is formed to provide increased rigidity to the plate element.

14. A fire shutter according to claim 1, wherein the thickness of each plate element is about 5 mm.

15. A fire shutter according to claim 1, comprising an actuating mechanism connected to the plate elements for turning the plate elements from the open position to the closed position, and wherein the actuating mechanism comprises an energy storage device such that in the closed position of the plate elements a force is applied for positively urging the plate elements into the closed position.

16. A fire shutter according to claim 15, wherein the energy storage device is a compression spring.

17. A fire shutter according to claim 1, comprising a frame of rigid construction, the extent of which in the flow-through direction of the shutter is greater than the pitch between the turning axes of the plate elements, and wherein the first and second plate elements each have a second edge that is opposite said one edge thereof and the turning axis for each plate element is located substantially halfway between said edges thereof and substantially halfway through the frame in the flow-through direction of the shutter.

18. A fire shutter comprising a plurality of fire plate elements each having first and second opposite edges and first and second opposite sides, means supporting the fire plate elements adjacent to each other and turnable about respective parallel axes from a flow-through open position, in which gas-flow passages are formed therebetween, to a closed position, in which the first edge of one plate element of each two adjacent plate elements is close to the second edge of the other plate element of said two adjacent plate elements and the fire plate elements together form a closed barrier, wherein said first edge of said one plate element is provided with a sealing structure including a leaf part, which contacts the first side of said other plate element and laps over an area adjacent said second edge of said other plate element when the fire plate elements are in the closed position, and a transverse part which is substantially perpendicular to the leaf part and, when the fire plate elements are in the closed position, confronts said second edge of said other plate element and extends from the leaf part to beyond the second side of said other plate element, whereby distortion of said other plate element does not create a significant gap between said one plate element and said other plate element.

19. A fire closure shutter comprising a frame defining a flow conduit segment having two opposite ends, a plurality of fire plate elements each having first and second opposite sides, means supporting the fire plate elements adjacent to each other and turnable about respective parallel axes from a flow-through open position, in which the fire plate elements extend parallel to an axis of the conduit segment and gas-flow passages are formed therebetween, to a closed position, in which at least one edge of a first fire plate element is adjacent one edge of an adjoining second fire plate element and the fire plate elements extend perpendicular to the axis of the conduit and together form a closed barrier, wherein said one edge of the first fire plate element is provided with a sealing structure including a leaf part and a transverse part substantially perpendicular to the leaf part, the sealing structure being such that when the fire plate elements are in the closed position, the leaf part contacts the first side of the second plate element and laps over an area of the second plate element adjacent said one edge thereof and confronts the first side of the second plate element, and the first plate element includes a transverse part which is substantially perpendicular to the leaf part and, when the fire plate elements are in the closed position, confronts said one edge of the second plate element and extends from the leaf part to beyond the second side of the second plate element, whereby distortion of the second plate element does not create a significant gap between the first and second plate elements.

* * * * *

UNITED STATES PATENT AND TRADEMARK OFFICE
CERTIFICATE OF CORRECTION

PATENT NO. : 5,425,673
DATED : June 20, 1995
INVENTOR(S) : Timo MAHLANEN et al

It is certified that error appears in the above-identified patent and that said Letters Patent is hereby corrected as shown below:

Cover sheet, left column, item [56], in the list of U.S. PATENT DOCUMENTS, "3,360,018" should read --3,260,018--.

Cover sheet, left column, item [56], in the list of references cited should be included:

OTHER DOCUMENTS

Drawing No. DAF-D-3465, American Warming and Ventilating, Inc., April 1, 1963

Signed and Sealed this

Eighth Day of April, 1997

*Attest:*

Bruce Lehman

BRUCE LEHMAN

*Attesting Officer*

*Commissioner of Patents and Trademarks*